United States Patent [19]

Retzloff et al.

[11] Patent Number: 5,020,601

[45] Date of Patent: Jun. 4, 1991

[54] CONCEALED SPRINKLER ASSEMBLY

[75] Inventors: James G. Retzloff, Lansing; Gerald W. Sanders, Middleville, both of Mich.

[73] Assignee: Viking Corporation, Hastings, Mich.

[21] Appl. No.: 499,065

[22] Filed: Mar. 26, 1990

[51] Int. Cl.[5] ..... A62C 37/12

[52] U.S. Cl. ..... 169/37; 239/288.5

[58] Field of Search ..... 169/37, 38, 39, 40, 169/41, 42, 90; 239/288, 288.3, 288.5

[56] References Cited

U.S. PATENT DOCUMENTS

| | | | |
|---|---|---|---|
| 3,285,470 | 11/1968 | Frei et al. . | |
| 3,727,695 | 4/1973 | Danton | 169/37 |
| 3,889,314 | 6/1975 | McCabe . | |
| 4,014,388 | 3/1977 | Anderson | 169/37 |
| 4,066,129 | 1/1978 | Anderson | 169/37 |
| 4,074,388 | 2/1978 | McCabe . | |
| 4,805,261 | 2/1989 | Barchechat . | |
| 4,880,063 | 11/1989 | Leininger et al. | 169/37 |
| 4,926,946 | 5/1990 | Polan | 169/37 |

OTHER PUBLICATIONS

AS Sprinkler Corp. of America Central Sprinkler Corp. "Adjustable Royal Flush Sprinkler Model 76A".

Central Sprinkler Copr. "Adjustable Royal Flush Sprinkler Model A" Eclipse Sprinkler.

Concealed Sprinkler Model F946-Grinnell Corporation Reliable Model G1.

Reliable Model G-4 Star-Model H The Unspoiler.

Concealed Sprinkler Phantom 1, Model PH-1-Star Sprinkler Corp.

*Primary Examiner*—Sherman D. Basinger

*Assistant Examiner*—Stephen P. Avila

*Attorney, Agent, or Firm*—Price, Heneveld, Cooper, DeWitt & Litton

[57] ABSTRACT

A concealed sprinkler assembly includes a sprinkler head having a body defining a nozzle, an arm structure extending from the nozzle and a deflector mounted on the arm assembly opposite the nozzle. A mounting or gauge base is secured to the sprinkler head. The base positions the deflector and head with respect to a ceiling. A cover plate is snapped onto the sprinkler head assembly by a pair of metal clips. The clips are fabricated from a material which returns towards an original prebent configuration upon being exposed to a predetermined ambient temperature thereby releasing the cover plate from the assembly.

16 Claims, 3 Drawing Sheets

CONCEALED SPRINKLER ASSEMBLY

BACKGROUND OF THE INVENTION

The present invention relates to automatic fire protection systems and more particularly to concealed sprinkler head assemblies.

Various forms of automatic fire protection systems are available. Wet pipe systems include a main water supply and a plurality of branches. Pendent type automatic sprinkler heads are connected to the branches of the piping system along the ceiling of areas which are to be protected. Each automatic sprinkler head includes a body defining a nozzle or orifice, an arm structure and a deflector positioned opposite the nozzle. A plug or pip cap is held in the nozzle by a thermal trigger. The trigger may be a fusible link device or a glass bulb. When a predetermined temperature is reached, the bulb bursts or the link fuses thereby releasing the cap. Water flowing from the orifice strikes the deflector forming a uniform spray pattern to extinguish o control the fire.

Automatic fire protection systems of the above type are used in many environments including factories, warehouse facilities, offices, motels, hotels, residents and hospitals. In certain applications such as offices, hotels and the like, aesthetics are important. Proposals have been made to conceal each sprinkler head at the point where it penetrates openings formed in the ceiling. Concealed sprinkler head assemblies generally include an enclosure or mounting base and a cover plate which engages the ceiling and conceals the sprinkler head opening and the head assembly itself. The cover is typically attached to the enclosure or the sprinkler head assembly by a fusible link or meltable solder. Some of the prior devices use springs to secure or retain the cover plate in position or to eject the plate from the assembly when a predetermined temperature is reached. The fusible solder is selected so that the cover plate is released at a temperature just below that which would result in actuation of the sprinkler head. Should the springs, fusible links or solder break, the entire assembly may need to be replaced. The prior assemblies ar fragile and present problems with manufacture, assembly, installation and service.

SUMMARY OF THE INVENTION

In accordance with the present invention, the aforementioned problems are substantially eliminated. Essentially, a concealed sprinkler head assembly is provided which includes a cover plate. A clip means is secured to the cover plate for releasably securing the plate to the sprinkler head assembly in a snap-on detent fashion. The clip means automatically releases the cover plate when exposed to a predetermined ambient temperature indicating a fire condition. The clip means is modifiable and replaceable in the field. In narrower aspects of the invention, the clip means includes a pair of clip members which are fabricated and configured from a ternary copper-zinc-aluminum alloy. The clips are initially stamped as flat blanks and heat treated. Subsequent to heat treating, the clips are bent to the desired configuration and secured to the cover plate. When exposed to a predetermined transformation temperature, the clip tends to return to its original preheat treated configuration.

The cover assembly and clips in accordance with the present invention are easily installed in the field. Problems previously experienced with the fragility of the devices such as those with fusible solder links are eliminated. The clips are bendable in the field to insure that the cover plates are securely attached to the sprinkler head assemblies. Relatively precise control of the release temperature is achievable. The present invention reduces the complexity previously associated with concealed sprinkler head assemblies and reduces the cost of manufacture and installation.

DETAILED DESCRIPTION OF THE PREFERRED EMBODIMENT

Figure 1:
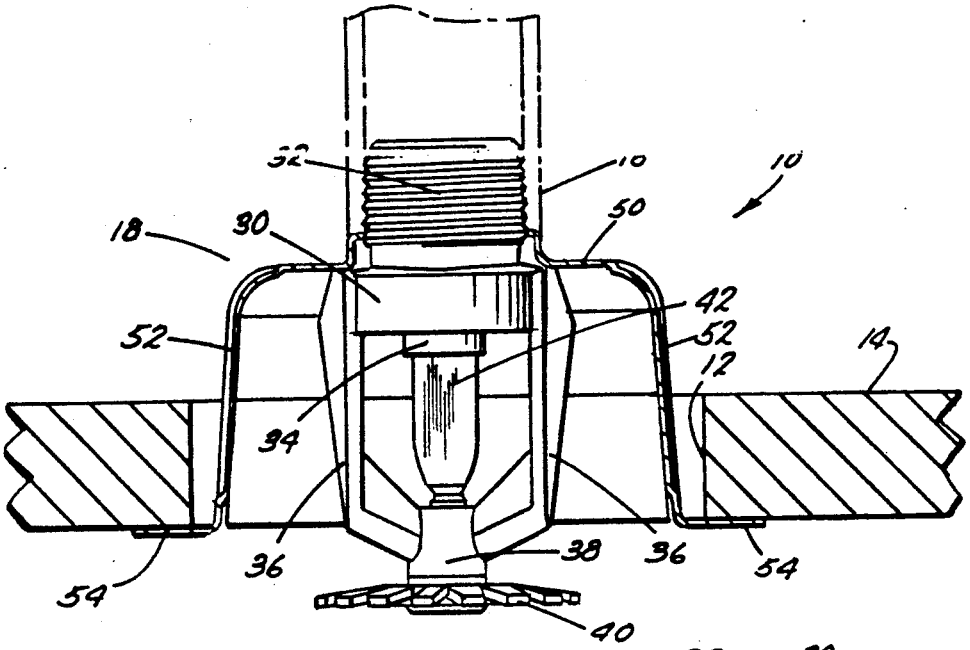
FIG. 1 is an exploded side, elevational view in partial cross-section of a concealed sprinkler head assembly in accordance with the present invention.
Figure 1:
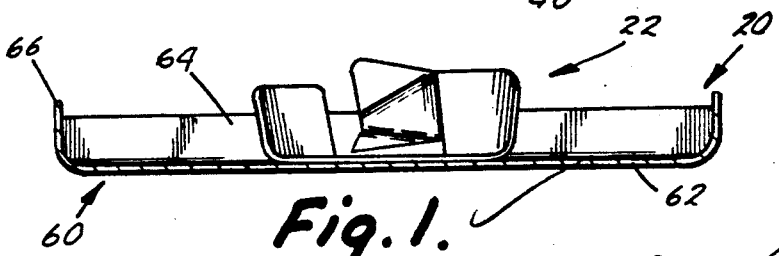
Figure 2A:
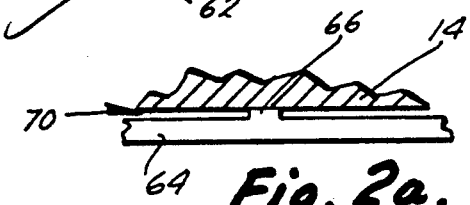
FIG. 2*a* is a fragmentary, cross-sectional view taken generally along line II a —II a of FIG. 2.
Figure 2:
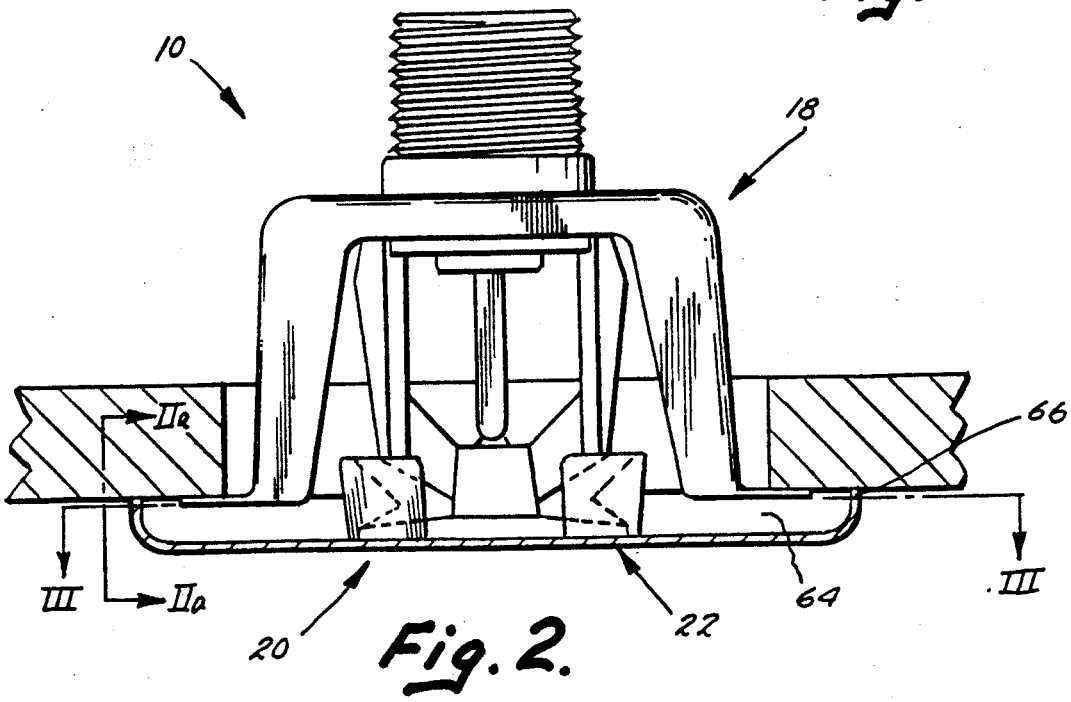
FIG. 2 is a side, elevational view in partial section of the concealed sprinkler head assembly.

A concealed sprinkler head assembly in accordance with the present invention is illustrated in FIGS. 1 and 2 and generally designated by the numeral 10. Assembly 10 is shown positioned within an opening 12 in a ceiling 14. Assembly 10 includes a sprinkler head subassembly 16, a mounting base, gauge base or plate 18 and a cover subassembly 20. Cover subassembly 20 is secured to the sprinkler head subassembly 16 by a clip means 22.

Automatic sprinkler head subassembly 16 includes a body 30 having a threaded portion 32 for attachment to a pendent or drop pipe of the sprinkler system piping. Body 30 defines a nozzle or orifice which is closed by a plug or cap 34. A pair of arms 36 extend from the body adjacent the nozzle. Arms 36 are joined at an end 38. A deflector 40 is secured to end 38. A thermal trigger 42 is positioned between portion 38 and cap 34. In the form shown, trigger 42 is a glass bulb filled with a suitable liquid. When exposed to a predetermined ambient temperature associated with a fire condition, the liquid expands, causing the bulb to shatter. This releases the cap or plug 34. Fluid pressure within the fire protection system forces the cap from the nozzle. Water strikes deflector 40 forming a suitable pattern within the area to be protected. Sprinkler head assembly 16 is a commercially available item.

Gauge plate or mounting base 18, as seen in FIGS. 1 and 2, is generally cup-shaped in cross section. Base 18 includes a generally circular base portion 50 and a plurality of outwardly and downwardly extending arms 52. Arms 52 terminate in horizontal flanges 54. As illustrated, base portion 50 defines an aperature which receives or is threaded onto portion 32 of body 30. Arms 52 are dimensioned so that the head will be positioned with the deflector 40 a predetermined distance below a ceiling line which is defined by and in the plane of the horizontal flanges 54. Ceiling tile 14 rests on flanges 54.

As seen in FIGS. 1, 2 and 2*a*, cover subassembly 20 includes a cover plate 60. Plate 60 is generally circular in plan and has a base 62 and a peripheral side wall 64. Extending upwardly at equally spaced points from peripheral side wall 64 are a plurality of projections 66. It is presently preferred that at least three projections be provided. As seen in FIG. 2*a*, the projections space the cover plate from the ceiling 14 to define an air gap 70. Gap 70 permits the environmental air to pass between the cover plate and the ceiling. Heated air from a fire will, therefore, actuate the clip means 22 and the thermal trigger 42.

Figure 3:
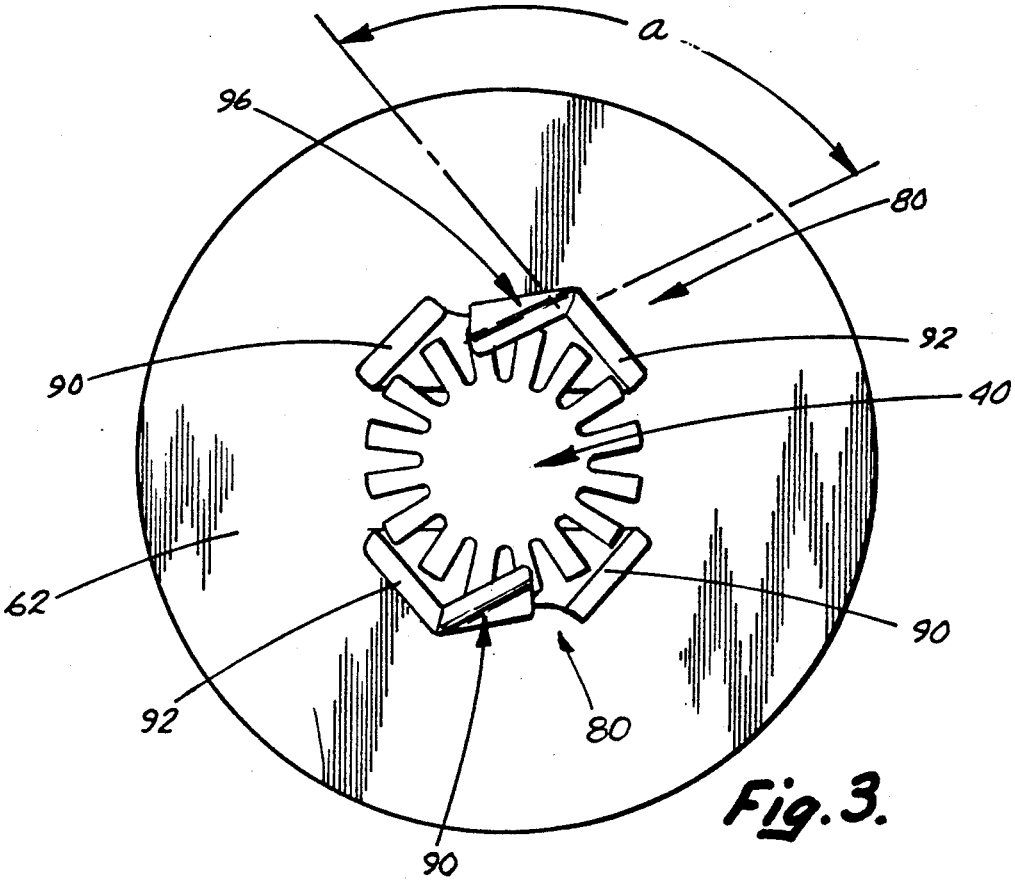
FIG. 3 is a cross-sectional view generally taken along line III—III of FIG. 2 showing the clips of the present invention in the retaining position.
Figure 4:
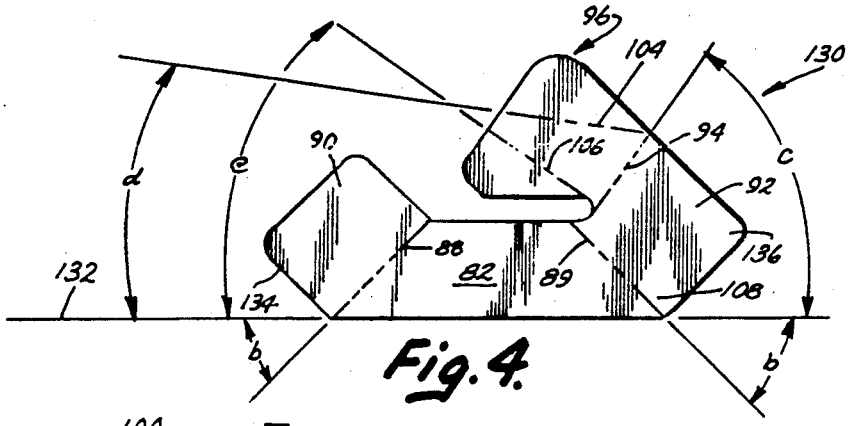
FIG. 4 is a plan view of a blank from which a clip incorporated in the present invention is formed.

Clip means 22 and its manner of attachment to the cover and sprinkler head are illustrated in FIGS. 3–6. Clip means 22 includes a pair of identical clip members or elements 80. Each clip member includes a generally trapezoidal shaped base 82 defined by parallel sides 84, 86 and nonparallel sides or fold lines 88, 89 (FIGS. 4 and 6*a*). Stop or retainer tabs 90, 92 are connected to base 82 at sides 88, 89. Tabs 90, 92 are generally rectangular in configuration. Tab 92 has a fold line 94. Joined to tab 92 at fold line 94 is a resilient actuator arm or detent tab 96. As seen in FIGS. 5*a*, 5*b*, 5*c* and 6*a*, resilient actuator arm 96 has a generally truncated V-shape in cross section including a planar base portion 98 and wings or petals 100, 102 joined to base portion 98 along fold lines 104, 106, respectively. The resilient actuator arm 96 is joined to end tab 92 adjacent a transition portion 108 (FIG. 5*a*). Wing 102 extends outwardly and downwardly in spaced relationship to base 82. Wing 100 extends outwardly and upwardly. Actuator ar 96 will resiliently bend and pivot around fold line 94. It is presently preferred that the clips be secured to a central area of the cover base 62 by a suitable epoxy or other adhesive.

In the preferred form, cover subassembly 20 is attached directly to the sprinkler subassembly by pushing the cover upwardly until deflector 40 engages wings 100 which cam arms 96 outwardly until the arms snap over the circular deflector. This retention position is illustrated in FIGS. 2 and 3. As shown in FIG. 3, a pair of clips 80 are positioned so that the stop or retaining tabs 90, 92 extend along tangents to the circular periphery of deflector 40. The clips, therefore, retain the deflector actuator arms 96 and securely retain the cover plate on the deflector.

Figure 3A:
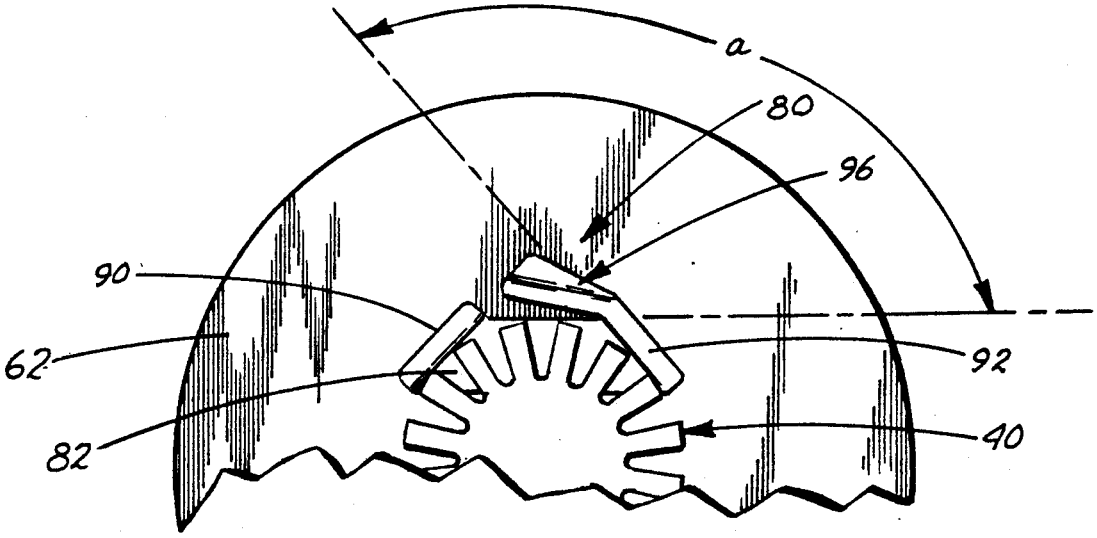
FIG. 3*a* is a fragmentary, cross-sectional view taken generally along line III—III of FIG. 2 showing the clips in the open or release position.

Clips 80 are each fabricated from a copper-zinc-aluminum ternary alloy. The commercially available alloy possesses a memory property or characteristic. The material will tend to return to an initial configuration when a transformation temperature is reached. The clip is configured so that when a predetermined temperature is reached, arms 96 pivot or move outwardly approximately 40° or more as shown in FIG. 3*a*. The clips are no longer positioned above deflector 40 and the cover can fall off of the deflector. The transformation temperature is selected so that the cover will release just prior to or at a temperature just below the actuation temperature for the sprinkler head.

As shown on FIGS. 3 and 3*a*, actuator arm 96 initially assumes an angle "a" with respect to stop tab 92 of approximately 96°. At the transformation temperature, the arm will fold or open outwardly much like the petal of a flower so that the angle "a" increases to at least 155°. The functioning of the actuator arm is achieved through proper selection of the ternary alloy and proper bending or configuring of a stamped plate or blank from which the clip is fabricated.

Figure 5A:
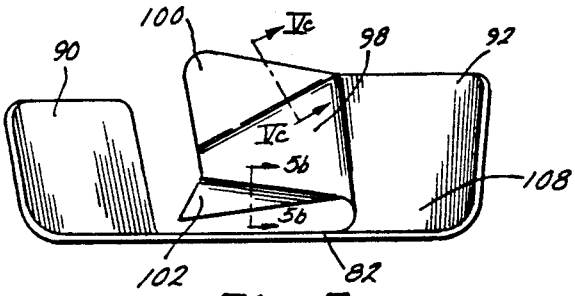
FIG. 5*a* is an elevational view of the clip incorporated in the present invention.
Figure 5B:
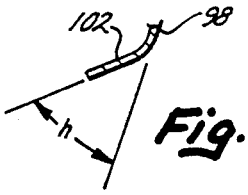
FIG. 5 *b* is a cross-sectional view taken generally along line V b —V b of FIG. 5*a;*
FIG. 5*c* is a cross-sectional view taken generally along line V c —V c of FIG. 5*a;*
Figure 5C:
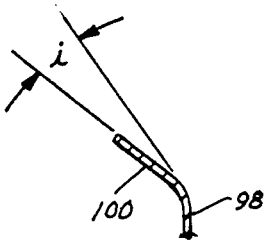
Figure 6A:
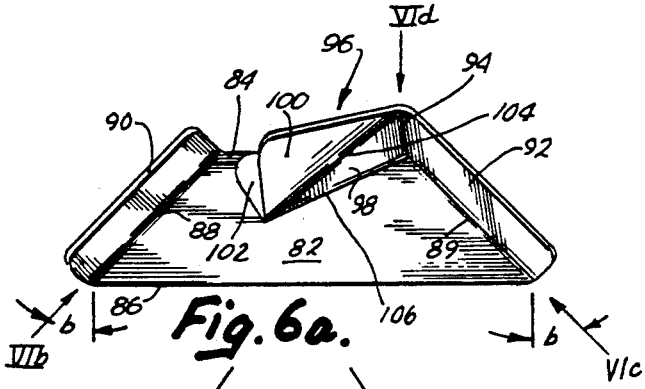
FIG. 6*a* is a top, plan view of the clip.
Figure 6B:
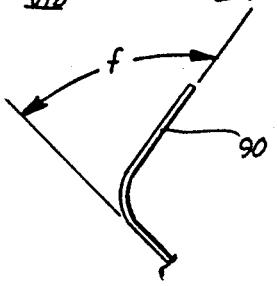
FIG. 6*b* is a view taken generally along line VI b —VI b of FIG. 6*a;*
Figure 6C:
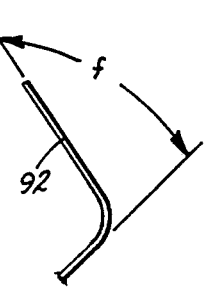
FIG. 6*c* is a view taken generally along line VI c —VI c of FIG. 6*a*.
Figure 6D:
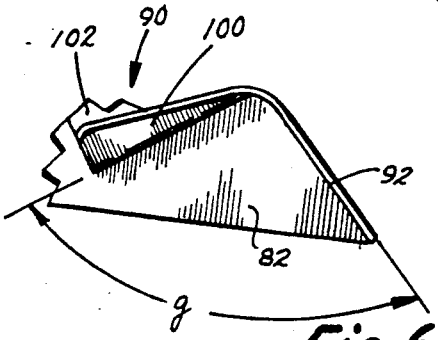
FIG. 6*d* is a view taken generally along line VI d —VI d of FIG. 6*a.*

As shown in FIG. 4, the clip is formed from a blank 130 stamped from a flat sheet of material. Blank 130 includes the trapezoidal shaped base 82, stop tab 90, tab 92 with transition portion 108 and actuator arm 96. Fold lines 88 and 89 assume an angle "b" of approximately 45° with respect to a horizontal base line 132. Stop tab portion 92 assumes an angle "c" of approximately 55° with respect to horizontal base line 132. Outer edges 134, 136 assume an angle of approximately 45° with respect to line 132. Fold line 106 is at an angle "e" of 35° from base line 132. After cutting blank 130 is heat treated and then, is bent with a forming die to the final configuration. Tabs 90, 92 are bent vertically to an angle "f" of approximately 80° (FIG. 6*b* and FIG. 6*c*). Resilient actuator arm 96 is bent along fold line 94 through an angle "g" of approximately 96°. As seen in FIGS. 5*b* and 5*c*, wing or petal 100 is bent with respect to planar portion 98 through an angle "h" of 20°. Lower petal or wing 102 is bent through an angle "i" of approximately 90°. When the transformation temperature for the alloy selected is reached, the clips tend to return to their original configuration resulting in opening movement of the actuator arms 96 as shown in FIGS. 3 and 3*a*. It is presently preferred that the transformation temperature be within the range of 52° to 56° C. The actuator arms will open and release the cover at a temperature just before actuation of the thermal trigger.

To install the sprinkler assembly, base 18 is threaded onto portion 32 of the sprinkler head. A small amount of pipe joint compound or tape is applied to the male threads. A sprinkler wrench is then used to thread the head onto the piping. Next, cover subassembly 20 is snapped onto the deflector. Care should be taken not to pus projections 66 into the cealing. Clips 80 snap onto the deflector. The clips can be bent or adjusted in the field to insure an adequate or proper fit. The assembly is relatively easy to manufacture and assemble. The assembly provides an aesthetically pleasing low profile concealed sprinkler.

In view of the foregoing description those of ordinary skill in the art may envision various modifications which would not depart from the inventive concepts disclosed herein. For example, the clips could capture or retain a separate member extending from the mounting base as opposed to direct retention on the deflector. The above description should, therefore, be considered as only that of the preferred embodiment. The true spirit and scope of the present invention may be determined by reference to the appended claims.

The embodiments of the invention in which an exclusive property or privilege is claimed are defined as follows.

1. A concealed sprinkler assembly, comprising:

a sprinkler head assembly including a body defining an orifice an arm extending from said body and a deflector mounted on said arm opposite said orifice;

a mounting base secured to said sprinkler head body;
a cover plate; and
clip means on said cover plate for resiliently securing said cover plate to said deflector in a snap-on detent fashion, said clip means releasing said cover plate from said deflector upon exposure to a predetermined ambient temperature, said clip means including a pair of opposed metal clips secured to said cover plate, each of said metal clips including:
a clip base;
end tabs integral with said clip base, said end tabs extending upwardly from said clip base; and
an actuator arm resiliently joined to one of said end tabs, said end tabs being configured and dimensioned to capture said deflector with the deflector being positioned between said cover plate and said actuator arms, said actuator arms each moving towards an initial prebent configuration upon exposure to said predetermined ambient temperature.

2. A concealed sprinkler assembly as defined by claim 1 wherein said clips are each fabricated from a ternary metal material which returns towards the initial, prebent configuration when the ambient temperature reaches a predetermined transformation temperature.

3. A concealed sprinkler assembly, comprising:
a sprinkler head assembly including a body defining an orifice an arm extending from said body and a deflector mounted on said arm opposite said orifice;
a mounting base secured to said sprinkler head body;
a cover plate; and
clip means on said cover plate for resiliently securing said cover plate to said deflector in a snap-on detent fashion, said clip means releasing said cover plate from said deflector upon exposure to a predetermined ambient temperature, clip means comprising a pair of individual, opposed metal clips secured to said cover plate, each of said metal clips including:
a clip base;
end tabs; and
an actuator arm joined to one of said end tabs, said end tabs being configured and dimensioned to capture said deflector with the deflector being positioned between said cover plate and said actuator arms, and
wherein said clip base is generally trapezoidal in plan view, said end tabs being joined to the nonparallel sides of said clip base and extending upwardly therefrom.

4. A concealed sprinkler assembly as defined by claim 3 wherein said actuator arm is joined to a side of one of said end tabs by a transition portion, said actuator arm having a generally truncated V-shape in cross section and thereby including angularly related petal portions.

5. A concealed sprinkler assembly as defined by claim 4 wherein said clips are each fabricated from a metal material which returns towards an initial, prebent configuration when the ambient temperature reaches a predetermined transformation temperature.

6. A concealed sprinkler assembly as defined by claim 5 wherein said clips are each initially stamped as flat pieces, heat treated and then bent to define said base, end tabs and actuator arm.

7. A concealed sprinkler assembly as defined by claim 6 wherein said clips are each fabricated from a copper-zinc-aluminum alloy.

8. A concealed sprinkler assembly as defined by claim 7 wherein said alloy has a transformation temperature of approximately 57° C.

9. A concealed sprinkler assembly as defined by claim 8 wherein said mounting base includes a plurality of depending arms, each arm terminating in an angled, ceiling engaging portion.

10. A cover assembly for a concealed automatic sprinkler assembly, comprising:
a cover plate; and
clip means on said cover plate for resiliently securing said cover plate to said sprinkler assembly in a snap-on detent fashion and for releasing said cover plate from said sprinkler assembly upon exposure to a predetermined ambient temperature, said clip means including a pair of individual, opposed ternary alloy metal clips secured to said cover plate, said clips returning towards an initial, prebent configuration when the predetermined ambient temperature is reached thereby releasing said cover plate, each of said metal clips including a clip base, end tabs joined to and extending upwardly from said clip base, and a detent tab joined to one of said end tabs, said end tabs being configured and dimensioned to capture at least a portion of said sprinkler assembly with the portion of said sprinkler assembly being positioned between said cover plate and said detent tabs.

11. A cover assembly for a concealed automatic sprinkler assembly, comprising:
a cover plate; and
clip means on said cover plate for resiliently securing said cover plate to said sprinkler assembly in a snap-on detent fashion and for releasing said cover plate from said sprinkler assembly upon exposure to a predetermined ambient temperature, said clip means comprising a pair of individual, opposed metal clips secured to said cover plate, each of said metal clips including:
a clip base;
end tabs; and
a detent tab joined to one of said end tabs, said end tabs being configured and dimensioned to capture said sprinkler assembly with-the sprinkler assembly being positioned between said cover plate and said detent tabs, and wherein said clip base is generally trapezoidal in plan view, said end tabs being joined to the nonparallel sides of said clip base and extending upwardly therefrom.

12. A cover assembly as defined by claim 11 wherein said detent tab is joined to a side of one of said end tabs by a transition portion, said detent tab having a generally truncated V-shape in cross section and thereby including angularly related wing portions and a planar base portion.

13. A cover assembly as defined by claim 12 wherein said clips are each initially stamped as flat pieces, heat treated and then bent to define said base, end tabs and detent tab.

14. A cover assembly as defined by claim 13 wherein said clips are each fabricated from a copper-zinc-aluminum alloy.

15. A cover assembly as defined by claim 14 wherein said alloy has a transformation temperature of approximately 57° C.

16. A cover assembly as defined by claim 15 wherein said cover plate is generally cup-shaped and includes a base, a peripheral side wall and a plurality of upwardly extending air gap projections.

* * * * *